US005173064A

United States Patent [19]

Audeval

[11] Patent Number: 5,173,064

[45] Date of Patent: Dec. 22, 1992

[54] SYSTEM COMPRISING HIGH-RELIABILITY TERMINAL BLOCK AND ASSOCIATED JUMPER LINK STOWAGE DEVICE

[75] Inventor: Fabrice Audeval, Aiglemont, France

[73] Assignee: Mars Actel, Vrigne Aux Bois, France

[21] Appl. No.: 775,468

[22] Filed: Oct. 15, 1991

[30] Foreign Application Priority Data

Oct. 12, 1990 [FR] France ..... 90 12624

[51] Int. Cl.[5] ..... H01R 9/22

[52] U.S. Cl. ..... 439/709; 439/395

[58] Field of Search ..... 439/709, 712, 713, 714, 439/716, 719, 395, 403, 404

[56] References Cited

U.S. PATENT DOCUMENTS

| | | | |
|---|---|---|---|
| 3,611,264 | 10/1971 | Ellis, Jr. | 439/403 |
| 3,957,335 | 5/1976 | Troy . | |
| 4,066,317 | 1/1978 | Bierenfeld et al. | 439/403 X |
| 4,552,429 | 11/1985 | van Alst | 439/403 X |
| 4,629,279 | 12/1986 | Nishikawa | 439/404 |
| 4,743,212 | 5/1988 | Neuwirth | 439/719 X |
| 4,824,403 | 4/1989 | De Luca et al. | 439/719 X |
| 4,836,803 | 6/1989 | Seidel | 439/719 X |

FOREIGN PATENT DOCUMENTS

| | | |
|---|---|---|
| 0200883 | 7/1988 | European Pat. Off. . |
| 2611315 | 8/1988 | France . |

*Primary Examiner*—Paula A. Bradley
*Assistant Examiner*—Khiem Nguyen
*Attorney, Agent, or Firm*—Sughrue, Mion, Zinn, Macpeak & Seas

[57] ABSTRACT

A high-reliability terminal block and associated jumper link stowage device system has no wire guides in the grooves between rows of insulation-displacement connection chimneys of a terminal block body. A device has a plate with a row of teeth at the same pitch as the chimneys extending perpendicular to the plane of the plate. The teeth are wider than the grooves of the terminal block.

8 Claims, 3 Drawing Sheets

SYSTEM COMPRISING HIGH-RELIABILITY TERMINAL BLOCK AND ASSOCIATED JUMPER LINK STOWAGE DEVICE

BACKGROUND OF THE INVENTION

1. Field of the Invention

The present invention concerns terminal blocks used in telecommunications to connect telephone lines. It relates more particularly to the means of stowing jumper links on such blocks.

2. Description of the Prior Art

The aforementioned terminal blocks are used to cross-connect pairs of conductors of a high-capacity transport cable to pairs of conductors of lower capacity distribution cables or to cross-connect pairs of conductors of such distribution cables to pairs of conductors of subscriber lines. The cross-connections are made between two blocks in a distribution frame or sub-distribution frame box by means of jumper links.

A terminal block of this kind is described in the document FR-A-2 611 315. It comprises an insulative block in which are mounted and insulated from each other individual connection members accessible from two sides of the block. On the front (relative to its location when in use) the block has rows of projecting chimneys. The connecting members terminate individually in these chimneys and define in them front connections assigned to the jumper links. On the back of the block the connection members define corresponding rows of rear connections assigned to the cable or line conductors.

The rows of chimneys on the front are separated from each other by grooves. These grooves are provided with wire guides for the two wires of the various jumper links for each row of chimneys or front connections. The wire guides are removably mounted in the grooves. They are flat parts made to suit the dimensions of the grooves. They have channels in both sides for the jumper link wires.

These channels are open along the front edge of the wire guide when fitted into its groove. They form at the ends of this front edge two sets of partitioned individual outlets for the wires of the various jumper links. The channels on the two sides are open alternately along this front edge, substantially facing the various chimneys of the row concerned.

These wire guides constitute the means for stowing jumper links in the grooves between chimneys. They:

ensure orderly wiring, prevent the wires creating short leakage lines between chimneys, result in a neat wired block.

The drawbacks of using these wire guides include:

the wire guides are extra parts of the block itself, they increase the time to wire each jumper link because:

- the individual outlets from the channels at the ends of the front edge of the wire guide must be identified as well as the front connections concerned,
- before the jumper link wires are inserted into their channels, the two wires of each jumper link must be untwisted over a length at least equal to that of the channels which receive them or in general that of the longest channel,
- they create a loop at the outlet from each channel substantially facing each chimney to provide the extra length of wire needed to make the connection to the front connection in the chimney,
- they require the slack to be taken up when the connections have been made by pulling on the wires from the sides of the block and stowing the slack resulting at the sides in the bed of jumper links located between two rows of blocks.

In practise the wire may not slide in its wire guide channel when disconnected from its front connection. It is then difficult to obtain access to, opposes removal of the wire guide from the groove and can only be recovered using special shape pliers.

An object of the present invention is to simplify the block whilst retaining the essential advantages of the aforementioned wire guides but avoiding their drawbacks.

SUMMARY OF THE INVENTION

The present invention consists in a high-reliability terminal block and associated jumper link stowage device system wherein said terminal block comprises an insulative body having on its front, rows of projecting chimneys at a regular pitch in each row, grooves between said rows of chimneys and transverse slots between said chimneys of each row and individual connecting members mounted and insulated from each other in said body and defining front connections in respective chimneys and rear connections at the rear of the block, said rear connections being assigned to cable conductors and said front connections being assigned to jumper link conductors, in which system said terminal block comprises no means for guiding and stowing said jumper links in said grooves fixed to said body and forming part of said terminal block and said jumper link stowage device comprises a separate tool comprising a plate provided, in a lower end part, with teeth perpendicular to the plane of said plate and spaced at the same pitch as said chimneys.

In this system, the dimensions of the teeth are adapted to secure accurate guiding of the device in the transverse slots between the chimneys of two consecutive rows and to secure abutment at the bottom of the slots, without the lower edge of the plate being able to damage the insulation of the jumper link conductors pushed into the bottom of the groove or overloading the points at which the conductors are connected to the front connections.

The block is itself provided with obstacles at the end of the respective grooves defining end rings for receiving and retaining jumper links substantially at the bottom of the grooves.

The features and advantages of the present invention will emerge from the following description of a preferred embodiment of the invention shown in the appended drawings.

DETAILED DESCRIPTION OF THE INVENTION

Figure 1:
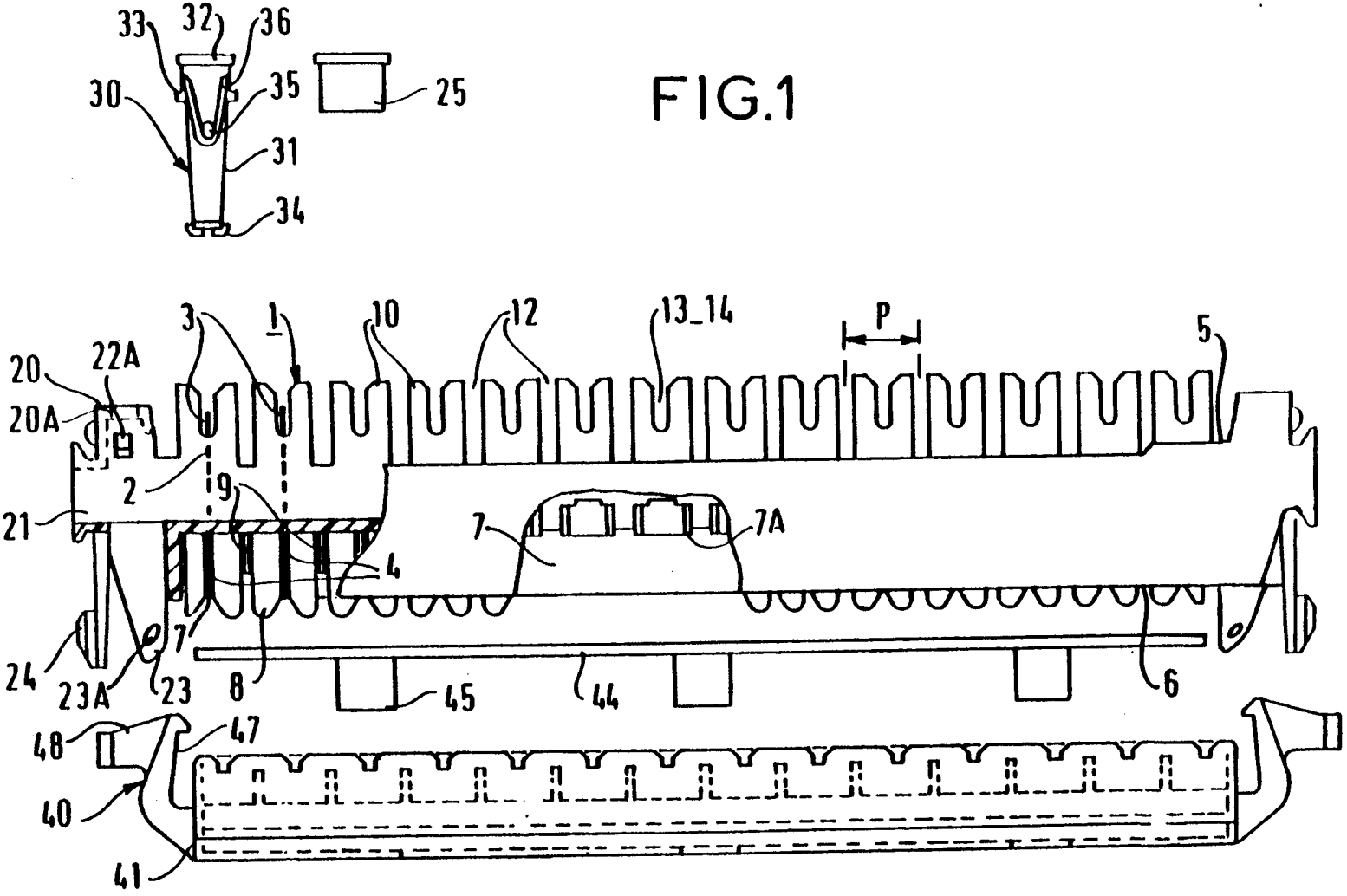
FIG. 1 is an exploded top plan view showing a block in accordance with the invention.
Figure 2:
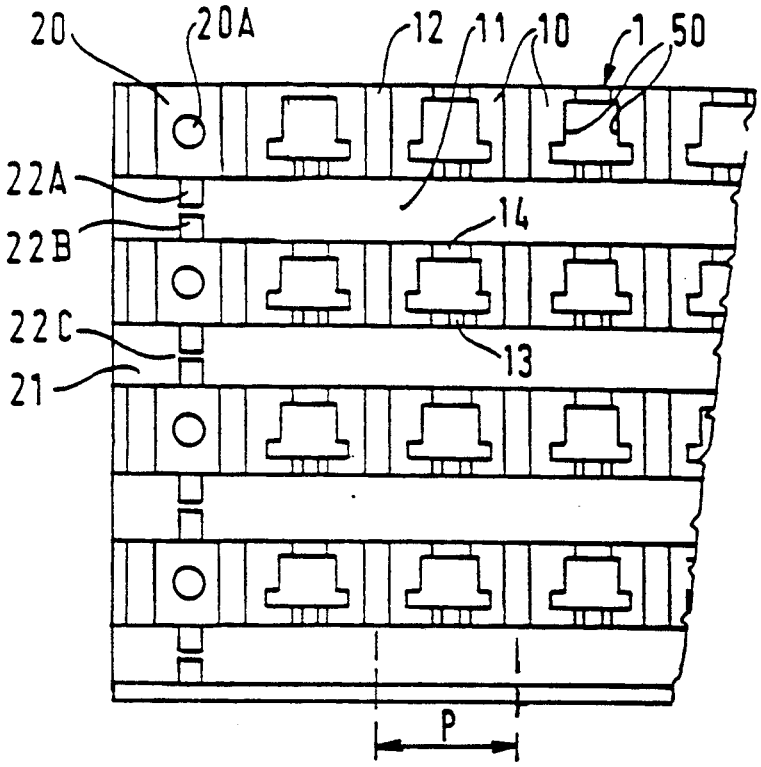
FIG. 2 is a partial front view to a larger scale of the insulative body of the block from FIG. 1.
Figure 3:
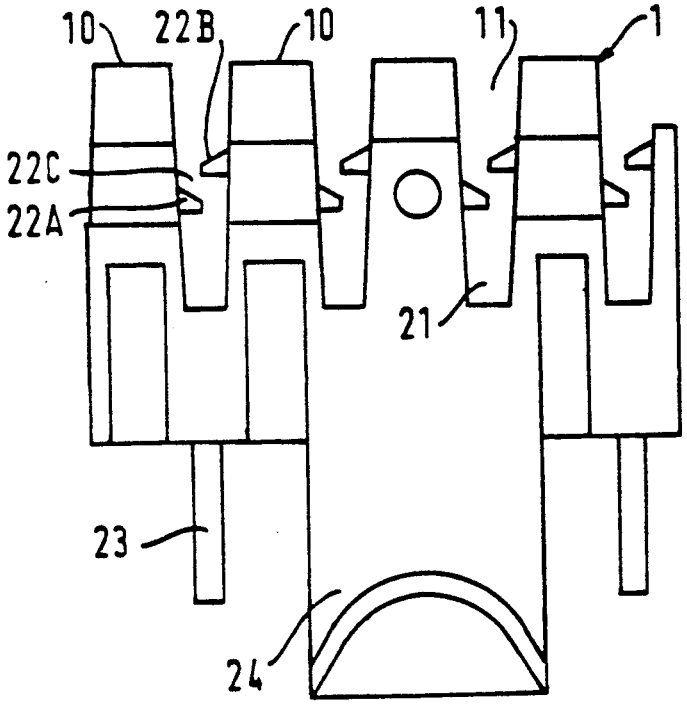
FIG. 3 is a side view of the insulative body of the block from FIG. 2.

Referring to FIGS. 1 through 3, a terminal block in accordance with the invention comprises a body 1 of insulative material provided with a plurality of individual connection members 2. The end portions of the connection members constitute connections 3 and 4. They are accessible from both the front 5 and the rear 6 of the block 1 ("front" and "rear" refer to the position in which the terminal block is used) and are disposed in a plurality of rows on these two sides.

In this example the insulative block has four rows each of 14 connections on each of its front and rear for a 28-pair cable. These numbers may be different, of course.

The front connections 3 are assigned to the jumper link conductors and are preferably insulation-displacement connections. The rear connections 4 are assigned to the conductors of the various pairs of the cable (not shown). The connections 4 are insulation-displacement or some other type connections. The connection of the conductors of the various pairs to the connections 4 is regarded as fixed and definitive, although it is possible to obtain access from the rear to modify pairs previously decided on. Those at the front can be modified as required.

The connecting members 2 are firmly retained in the block. The connections 4 on the rear 6 are surrounded by a continuous rib 7 and a series of pairs of ribs 8 on the longitudinal edges of each row, referred to hereinafter as longitudinal ribs, and by ribs 9 transverse to each row.

The connecting members 2 are retained in the block 1 by the continuous ribs 7. As shown in the cutaway area in the block 1 from FIG. 1, the edge of each continuous rib 7 has chocks 7A for retaining the connecting members of the row concerned against the inside edge of the pairs of ribs 8 formed on the block. Each continuous rib 7, originally separate from the block 1, is ultrasonically welded to the block after the connecting members are mounted in and secured to the block.

Once the continuous rib 7 at the top end is welded to the block it constitutes the fourth side wall of a well defined all around the periphery of the rear 6 of the block. This well may be filled with a sealing product when the pairs of conductors have been connected to the connections 4.

In the block 1 the insulation-displacement front connections 3 are disposed in individual chimneys 10. They have bosses on their branches to cut the insulation of the conductors as they are inserted between the branches.

The chimneys are in one piece with the block and defined in longitudinal ribs on its front. For each rib there is a row of chimneys 10 associated with a row of insulation-displacement connections 3. Each row of chimneys 10 is separated from the adjacent row by a longitudinal groove 11 for the jumper links for the row of chimneys above it, a groove 11 being also provided for the lower row of chimneys. Each chimney 10 in each row is separated from the adjacent chimney by a transverse slot 12. In each row the chimneys have a regular pitch P. The transverse slots 12 are in face-to-face relationship between the rows.

The chimneys 10 have two lateral slots 13 and 14 on their walls extending lengthwise of the row. The two slots 13 and 14 face each other and the axis of the insulation-displacement connection in the chimney. The slot 13 which is the lower slot (relative to the position in which the terminal block is used) is narrower than the other, i.e. upper slot 14 and its width is slightly less than the diameter of the jumper link wires. It locks or clamps securely in position the conductor connected to its insulation displacement connection 3 at a point near this connection.

The grooves 11 between rows of chimneys are free of any type of wire guide device for stowing and retaining the conductors of the jumper links.

The block 1 has two rows of upstanding columns 20 at both ends of the rows of chimneys. The columns 20 are aligned with the rows of chimneys and define between them and below the bottom column grooves 21 extending the grooves 11 which therefore open onto the sides of the block.

The columns 20 project slightly less than the chimneys 10.

Each column 20 can receive a jumper link identifying stud (not shown) in the corresponding groove 21 or 11 locked in a hole 20A provided on its end face.

Each of the columns 20 also has a boss or obstacle 22A or 22B forming between the columns pairs of obstacles 22A and 22B in substantially face-to-face relationship and projecting into the groove 21 between them.

These pairs of obstacles define between them and the bottom of the end grooves 21 wire rings assigned to the jumper links for the row of chimneys. They separate the sets of jumper link for the various rows of chimneys from the lateral bed of jumper links and retain each set in the bottom of the groove 21 or 11.

The front gap 22C between the two obstacles of each pair is used to disengage the jumper links.

In corresponding relationship to the front upward columns 20 are rear lugs 23 facing the grooves 21 and projecting from the rear of the block 1, forming an integral part of the row of columns and of the block. The rear lugs 23 have a hole 23A at the end for attaching to them cable conductors connected to the various rows of rear connections 4. They also stiffen the block at its ends.

The block 1 also has two snap-fastener lugs 24 at the sides for mounting it on and securing it to a rear support (not shown).

The terminal block further comprises single or double caps or preferably plungers, for example the single cap 25 shown in FIG. 1 or the single plunger 30 also shown for the preferred embodiment in FIG. 1. They are associated with the block 1, in particular to protect the insulation-displacement connections in the individual chimneys 10 of the front side. The terminal block also comprises caps 40 in the form of a protection bar associated with the block 1 for each row of connections 4 on the back. The plungers 30 or the caps 25 close the chimneys 10 after the jumper links are connected to the connections 3. The caps 40 cover the rows of connections 4 after the pairs of cable conductors have been connected to the connections 4. The caps 25 or 40 are filled with special gel or grease to obtain effective protection.

The cap 40 is formed by a hollow U-section bar 41 and comprises a piston plate 44 inside the U-section bar with studs 45 projecting outwardly on the bottom of the U-shape which act on the plate 44 to distribute the gel and to fill completely and seal the row of connections 4. The transverse ribs 9 separate the connections 4 of each row on the back 6 and provide end-of-travel abutments for the piston plate 44.

Two side snap-fastener lugs 47 retain the cap 40 firmly to the insulative block 1. A tab 48 projecting from each lug enables the cap 40 to be removed from body 1, if necessary.

The single plunger 30 which is the preferred embodiment of protection of the insulation-displacement connections 3 inserts a jumper link conductor into the required insulation-displacement connection 3 in its chimney 10 or extracts the already fitted conductor and protects the insulation-displacement connection 3 with or without its jumper link conductor by closing off the chimney.

It has a single leg 31 complementary to the inside contour of each chimney for effective guidance and split longitudinally so that it can straddle the insulation-displacement connection 3. It has a head 32 at the front which is used to operate the plunger and which closes off the chimney. It has side shoulders 33 between its leg 31 and its head 32 which locate the plunger in its pushed-in position in the chimney and snap-fastener lugs 34 at the end of the leg 31 whereby the plunger is trapped in the chimney and is located therein in its pulled-out position. The chimney itself is provided with internal shoulders (not shown) providing abutments for the lugs 34 in this pulled-out position.

A hole 35 in the front part of the leg 31 near the head receives a jumper link conductor which is connected to the front connection in the chimney simply by depressing the plunger from its pulled-out position to its pushed-in position. It also carries a guide Vee 36 for blind insertion of the conductor into the hole 35 on its lower surface and a conductor insertion viewing eyelet on its rear surface.

The terminal block 1 is associated with a specific device 50 for stowing the jumper links in the grooves between the rows of chimneys, which are free of any wire guide means.

This device 50 is described with reference to FIGS. 4 and 5 and with some reference to FIGS. 1 through 3 in respect of the parts of the block with which it cooperates.

The device 50 is not part of the block 1 itself. It is functionally equivalent to the wire guides mounted in the grooves between rows of chimneys in the prior art blocks, to contain in the grooves the jumper links connected to the front connections 3.

Figure 4:
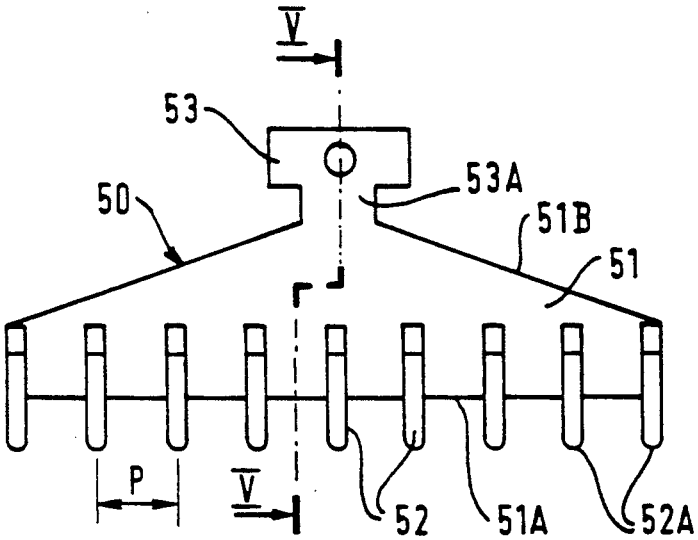
FIG. 4 shows the jumper link stowage device associated with said block.

This device is described as seen vertically, FIG. 4, although it is horizontal in the normal position in which it is used with the block. It comprises a plate 51 provided in its lower part with a row of teeth 52 and in its upper part with a handle 53. The plate 51 with the teeth 52 and the handle is preferably molded from a plastics material.

The teeth 52 are perpendicular to the plane of the plate 51 and spaced by the same pitch P as the chimneys of the block. They are complementary to the dimensions of the transverse slots 12 so that they can be inserted therein.

The teeth 52 project on either side of the plate 51. They have a lower part projecting beyond the lower edge 51A of the plate and an upper part projecting from the plate itself. Their total length is greater than the depth of the transverse slots 12. The length of their lower part is less than the depth of the transverse slots 12 but slightly greater than the distance between the bottom of the slots 12 and the point at which the conductors are retained at the bottom of the slots 13 in the walls of the chimneys. They are wider than the grooves 11 and inserted into the transverse slots of two consecutive rows of chimneys.

Figure 5:
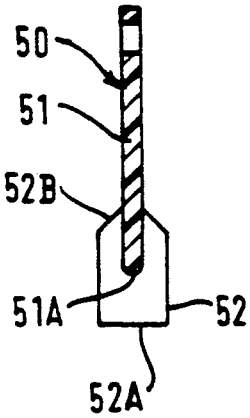
FIG. 5 is a view of this device in cross-section on the line V—V in FIG. 4.

As shown in FIGS. 4 and 5, the lower edge 51A of the plate and the lower edge 52A of the teeth are rounded and have no sharp edges able to damage the conductor insulation.

The upper edges 52B of the teeth 52 merge with the two sides of the plate are chamfered at substantially 45°.

The handle 53 is in the plane of the plate 51 and centered on its upper edge 51B. It merges with the upper edge of the plate via a narrower section 53A to make it easier to manipulate. The upper edge 51B of the plate is oblique on each side of the handle to enhance the effect of the narrower section 53A.

The device 50 is shorter than the grooves 11 and slightly longer than half their length. It is used twice to stow all the jumper links in the same groove. Of course, this dimension is in no way limiting on the invention and can be different and in particular it can match the length of the grooves.

The jumper links are stowed in their groove after connecting them to all or some of the insulation-displacement connections of the row of chimneys. To do this the device is grasped and positioned by hand in front of the block 1, with its plate 51 facing the groove into which the jumper links must be pushed and its teeth 52 facing the transverse slots 12 between the chimneys of the two rows on either side of the groove. It is then simply pushed home until its teeth 52 abut against the bottom of the transverse grooves 12. The lower edge 51A of the plate 51 is then disposed along the plungers in the pushed-in position in the chimneys, just in front of the wire outlets of the chimneys and of the plungers, so as not to damage the insulation of the jumper link conductors.

Note also that the apertures 22C in the wire rings enable direct insertion of jumper links between the pair of obstacles 22A, 22B and their retention at the bottom of the grooves 21, 11, in particular in the end grooves 21, and contribute to the proper retention of the jumper links when stowed in this way.

The advantages of this terminal block system with no wire guides and with an associated stowage device or tool include:

the simplified form of the block itself, which has no wire guides mounted in the grooves and snap-fastened into the insulative block, the reduced fitting time because of the absence of the prior art wire guides, the direct fitting of the jumper links of a row of chimneys in one or two operations, the absence of damage to the insulation, whereas a simple plate inserted into the groove might damage the insulation or apply undue loads to the points at which the conductors are connected to the insulation-displacement connections, the production of orderly wiring, the fact that there is no need to separate the two jumper link conductors which remain twisted together in the grooves as far as the plungers connecting the conductors to the front insulation-displacement connections.

There is claimed:

1. High-reliablity terminal block and associated jumper link stowage device system comprising; a terminal block including an insulative body having a front and a rear, rows of projecting chimneys evenly spaced at a regular pitch on the front of said body, grooves between said rows of chimneys, transverse slots between said chimneys of each row, individual connecting members mounted in said body and insulated from each other and defining front connections in respective chimneys proximate to the front of said body and rear connections proximate to the rear of said body, said rear connections being assigned to cable conductors and said front connections being assigned to jumper link conductors, said terminal block lacking means fixed to said body and forming part of said terminal block for guiding and stowing preconnected jumper link conductors in said grooves, and said system further comprising a jumper link stowage device consisting of a separate tool comprising a plate having an upper edge and a lower edge and provided in a lower end part with teeth extending perpendicular to the plane of said plate and said teeth being evenly spaced at the same pitch as the pitch of said chimneys.

2. System according to claim 1 wherein said teeth have a thickness and a length matching the width and the depth of said transverse slots between said chimneys and being insertably received therein.

3. System according to claim 2 wherein said teeth project to both sides of said plate and are wider than each of said grooves.

4. System according to claim 1 wherein each of said teeth have a lower part projecting beyond the lower edge of said plate over a length less than the height of said chimneys but of a length substantially greater than the distance between the entry of the conductors into said chimneys and the bottom of said transverse slots.

5. System according to claim 4 wherein the lower edge of each of said teeth and the lower edge of said plate are rounded.

6. System according to claim 1 wherein said plate has a handle on the upper edge of the plate.

7. System according to claim 1 wherein said terminal block further comprises at each end of said row of chimneys a side row of upstanding columns on said body and wherein each column at the end of a row of chimneys has at least one boss projecting into a respective groove, whereby said bosses form a pair of substantially facing obstacles in each groove with an access aperture between them and defining between them and a bottom of said groove a jumper link receiving and retaining ring.

8. System according to claim 7 wherein said terminal block further comprises side lugs on both ends of a cap and said cap is snap attached via said side lugs to the rear of said terminal block body.

* * * * *